US005966985A

United States Patent [19]

Shuto et al.

[11] Patent Number: 5,966,985

[45] Date of Patent: Oct. 19, 1999

[54] ENGINE STARTER

[75] Inventors: Shinji Shuto, Kakogawa; Yoshinobu Tanaka, Kako-Gun, both of Japan

[73] Assignee: Kawasaki Jukogyo Kabushiki Kaisha, Kobe, Japan

[21] Appl. No.: 08/927,456

[22] Filed: Sep. 11, 1997

[30] Foreign Application Priority Data

Oct. 22, 1996 [JP] Japan ..... 8-299482

[51] Int. Cl.[6] ..... F02N 15/02

[52] U.S. Cl. ..... 74/7 C; 192/45.1; 74/15.63; 74/6; 123/179.25; 123/179.28

[58] Field of Search ..... 74/7 C, 15.63, 74/6; 192/45.1, 45; 123/179.25, 179.26, 179.28

[56] References Cited

U.S. PATENT DOCUMENTS

| | | | |
|---|---|---|---|
| 4,792,028 | 12/1988 | Nishimura et al. | 192/45.1 |
| 4,848,170 | 7/1989 | Inagaki et al. | 74/7 C |
| 4,930,467 | 6/1990 | Masuda et al. | 123/179.28 |
| 4,961,486 | 10/1990 | Kinoshita et al. | 192/45.1 |
| 5,038,903 | 8/1991 | Akagi et al. | 192/45.1 |
| 5,265,706 | 11/1993 | Iga | 192/45 |
| 5,349,877 | 9/1994 | Bonin et al. | 74/7 C |
| 5,495,833 | 3/1996 | Ishizaka et al. | 123/179.25 |

FOREIGN PATENT DOCUMENTS

| | | | |
|---|---|---|---|
| 56-47624 | 4/1981 | Japan . | |
| 59-166729 | 9/1984 | Japan | 192/45.1 |
| 61-109923 | 5/1986 | Japan . | |
| 61-282644 | 12/1986 | Japan . | |
| 61-283763 | 12/1986 | Japan . | |
| 62-52226 | 3/1987 | Japan . | |
| 63-125229 U | 8/1988 | Japan . | |
| 7-83147 | 3/1995 | Japan . | |

*Primary Examiner*—Tamara L. Graysay
*Assistant Examiner*—William C Joyce
*Attorney, Agent, or Firm*—Oliff & Berridge, PLC

[57] ABSTRACT

An engine starter for starting an engine is provided with an overrunning clutch for transmitting the output torque of a starting motor to the crankshaft of the engine, having an outer ring formed integrally with a rotor holding rotary member having a boss fixedly put on an end portion of a crankshaft included in the engine, and holding a rotor included in a generator, an inner ring formed integrally with a driven member to be driven by the starting motor, and mounted on the end portion of the crankshaft for rotation relative to the crankshaft, and a clutch element interposed between the outer and the inner ring to transmit torque from the inner ring to the outer ring. A drive gear for driving an engine accessory is formed integrally with the rotor holding plate.

4 Claims, 3 Drawing Sheets

ENGINE STARTER

BACKGROUND OF THE INVENTION

1. Field of the Invention

The present invention relates to an engine starter for starting an engine of a personal watercraft, a motorcycle, a four wheeled vehicle, a four wheeled all terrain vehicle, etc.

2. Description of the Related Art

Referring to FIG. 3 showing a known engine starter for starting, for example, the engine of a motorcycle, disclosed in JP-A No. 61-283763, a plain bearing 52 is mounted on one end portion of a crankshaft 51 to which a piston 50 is connected, an inner ring 53*a* included in a cam type overrunning clutch 53 is put on the plane bearing 52, and a driven gear 54 is fastened to the inner ring 53*a*. A rotary member 57 has a boss 57*a* fixedly put on the end portion of the crankshaft 51 and a flange 57*b* fastened to an outer ring 53*c* included in the overrunning clutch 53.

When starting the engine, a starting motor 56 drives the driven gear 54 for rotation through a gear 55, the rotation of the driven gear 54 is transmitted through the inner ring 53*a*, a clutch element 53*b* included in the overrunning clutch 53 and the outer ring 53*c* to the boss of the rotary member 57 fixedly mounted on the end portion of the crankshaft 51 to drive the crankshaft 51 for rotation in order that the engine is started. Upon the increase of the rotating speed of the crankshaft 51 beyond a disengagement speed after the engine has been started, the overrunning clutch 53 allows the crankshaft 51 to rotate freely, and the driven gear 54 rotates for racing.

A cuplike member 59*a* is fastened to the rotary member 57 with bolts, and permanent magnets 59*b* are attached to the inner surface of the side wall of the cuplike member 59*a* to form a rotor 59 for a generator 58. Coils included in a stator 60 for the generator 58 are attached to a support plate 61, and the support plate 61 is fixed to a cover 62.

The known engine starter comprises a relatively large number of parts, requires much time and labor for assembling, relatively heavy and expensive, because the outer ring 53*c* of the overrunning clutch 53 is fastened to the rotary member 57, and the driven gear 54 is welded to the outer surface of the inner ring 53*a* of the same.

SUMMARY OF THE INVENTION

Accordingly, it is an object of the present invention to provide an engine starter comprising a relatively small number of parts, having a lightweight construction and capable of being manufactured at a relatively low cost.

According to one aspect of the present invention, an engine starter for starting an engine comprises: a starting motor; a rotor holding rotary member having a boss fixedly put on an end portion of a crankshaft included in the engine, and holding a rotor included in a generator; a driven member to be driven by the starting motor; and an overrunning clutch having an outer ring formed integrally with the rotor holding rotary member, and an inner ring placed on the driven member and mounted on the end portion of the crankshaft for rotation relative to the crankshaft.

Since the outer ring of the overrunning clutch is formed integrally with the rotor holding rotary member for holding the rotor of the generator, the engine starter comprises a relatively small number of parts, requires less time and labor for assembling, has a lightweight construction and can be manufactured at a relatively low cost.

In the engine starter, the overrunning clutch may be of a cam-type provided with a clutch element for transmitting torque from the inner ring to the outer ring, comprising a plurality of cams arranged on a circle between the outer and the inner ring. Since this overrunning clutch has a small radial thickness, the outer ring can be formed in a small diameter, which contributes to the reduction of the weight of the engine starter.

In this engine starter, the overrunning clutch may be provided with side plates on the opposite sides of the clutch element for transmitting torque from the inner ring to the outer ring to limit axial displacement of the clutch element, and a limiting plate for limiting displacement of the side plate on the side of the driven member toward the driven member may be mounted on the rotor holding rotary member. The limiting member prevents the side plate on the side of the driven member from coming into contact with the driven member.

In the engine starter, the inner ring of the overrunning clutch may be formed integrally with the driven member. When the inner ring is formed integrally with the driven member, the number of parts can further be reduced, assembling time and labor can be saved and the cost can be reduced.

In the engine starter, the rotor holding rotary member fixedly mounted on the crankshaft is provided integrally with a drive gear for driving an engine accessory. Since any separate drive gear for driving the engine accessory is not necessary, the number of parts can be reduced, assembling time and labor can be saved, the cost can be reduced, and the weight of the engine can be reduced.

The above and other objects, features and advantages of the present invention will become more apparent from the following description taken in connection with the accompanying drawings.

DESCRIPTION OF THE PREFERRED EMBODIMENT

Figure 1:
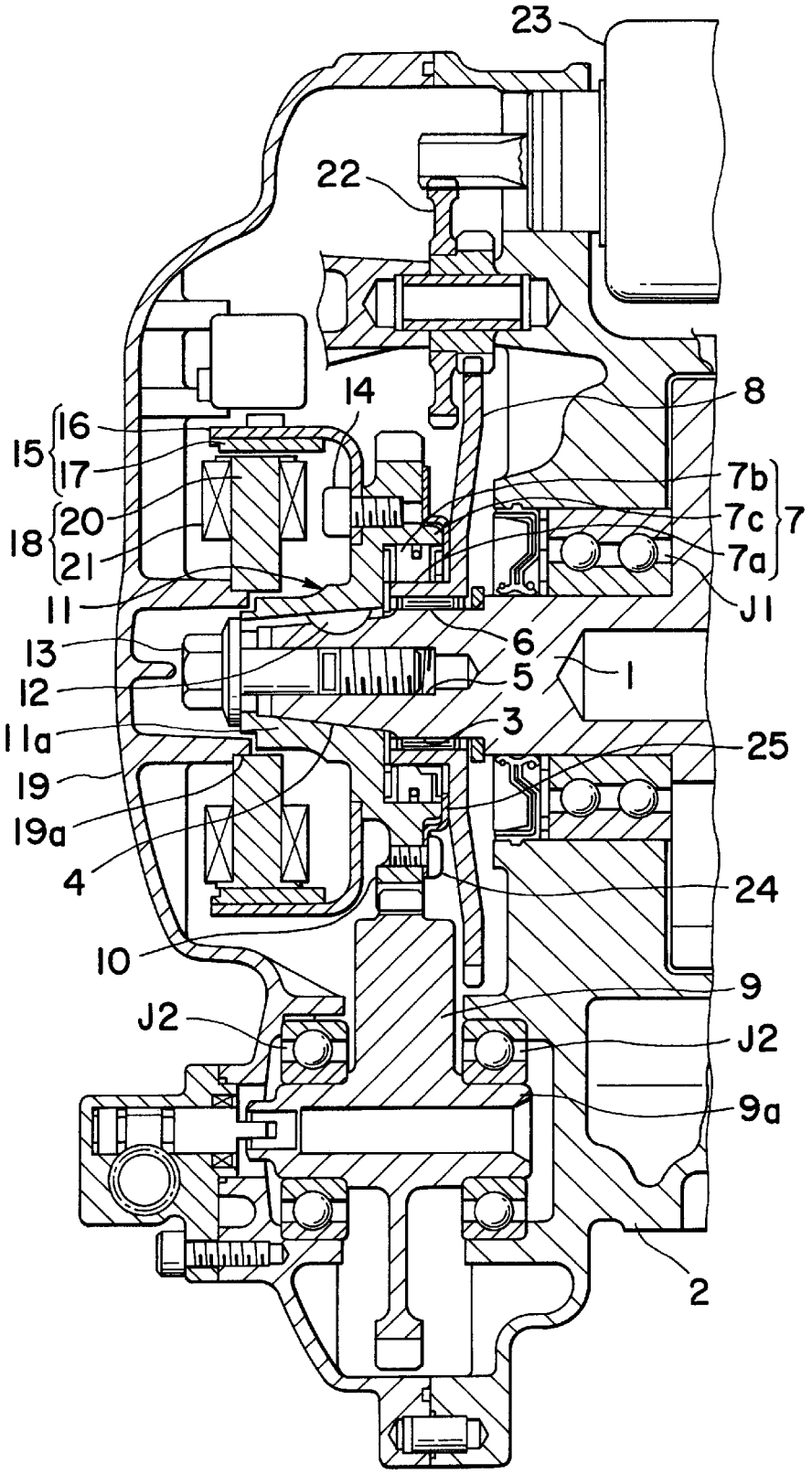
FIG. 1 is a fragmentary longitudinal sectional view of an engine provided with an engine starter in a preferred embodiment according to the present invention.

Referring to FIG. 1, a piston, not shown, is connected by a connecting rod to a crankshaft 1. The crankshaft 1 has one end portion supported for rotation in a bearing J1 on a side wall of a crankcase 2 so that the end portion projects outward from the side wall of the crankcase 2. A clutch mounting section 3 and a tapered section 4 continuous with the clutch mounting section 3 are formed in the end portion of the crankshaft 1. An axial threaded hole 5 is formed in the end portion of the crankshaft 1. A needle bearing 6 is mounted on the clutch mounting section 3, and an inner ring 7a included in a cam-type overrunning clutch 7 is formed integrally with a driven gear (driven member) 8 and is put on the needle bearing 6. A rotor holding rotary member 11 provided with a boss 11*a* is mounted on the tapered section 4, and a bolt 13 is screwed in the threaded hole 5 to fasten the rotary member 11 to the crankshaft 1. A key 12 prevents relative rotation between the crank shaft 1 and the boss 11*a*. An outer ring 7*c* is included in the overrunning clutch 7, and a driving gear 10 is provided for driving a balancer 9 for suppressing vibrations generated by the reciprocating piston. The outer ring 7*c* and the driving gear 10 are formed integrally with the rotary member 11. The balancer 9 has a shaft 9*a* supported at its opposite ends in bearings J2 on the side wall of the crankcase 2 and a cover 19, respectively.

A cuplike magnet holding member 16 is fastened to the rotary member 11 with bolts 14, and permanent magnets 17 are fixed to the inner surface of the side wall of the cuplike magnet holding member 17 to construct a rotor 15, which is included in a generator 18. The cover 19 is fixed to the side wall of the crankcase 2, a support plate 20 of a magnetic material serving as a core is fixed to a boss 19*a* projecting from the inner surface of the cover 19, and stator coils 21 included in the generator 18 are supported on the support plate 20.

An electric starting motor 23 drives the driven gear B for rotation through a compound gear 22 supported for rotation on the side wall of the crankcase 2 and the cover 19. The torque of the starting motor 23 is transmitted to the crankshaft 1 through the inner ring 7*a* of the overrunning clutch 7 formed integrally with the driven gear 8, a clutch element 7*b* included in the overrunning clutch 7, and the outer ring 7*c* formed integrally with the rotary member 11. Upon the increase of the rotational speed of the crankshaft 1 beyond a disengagement speed after the engine has been started, the clutch element 7*b* of the overrunning clutch 7 allows the crankshaft 1 to rotate freely.

Figure 2:
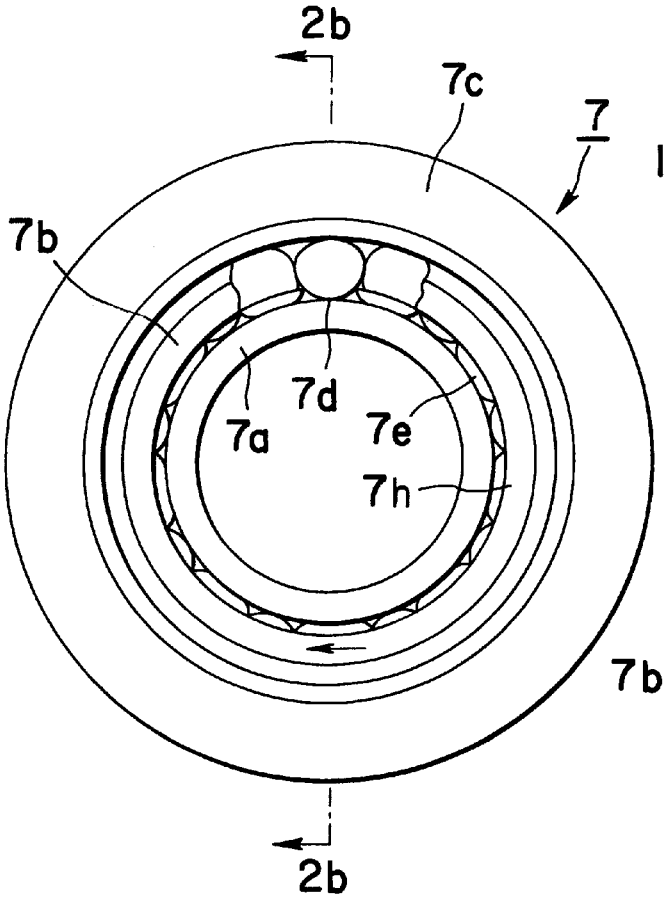
FIGS. 2(*a*) and 2(*b*) are a front view and a longitudinal sectional view, respectively, of a cam type overrunning clutch.
Figure 2:
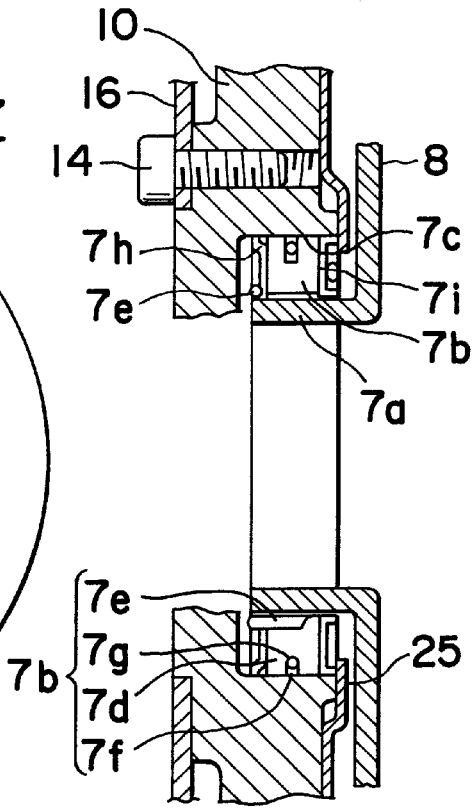
Figure 3:
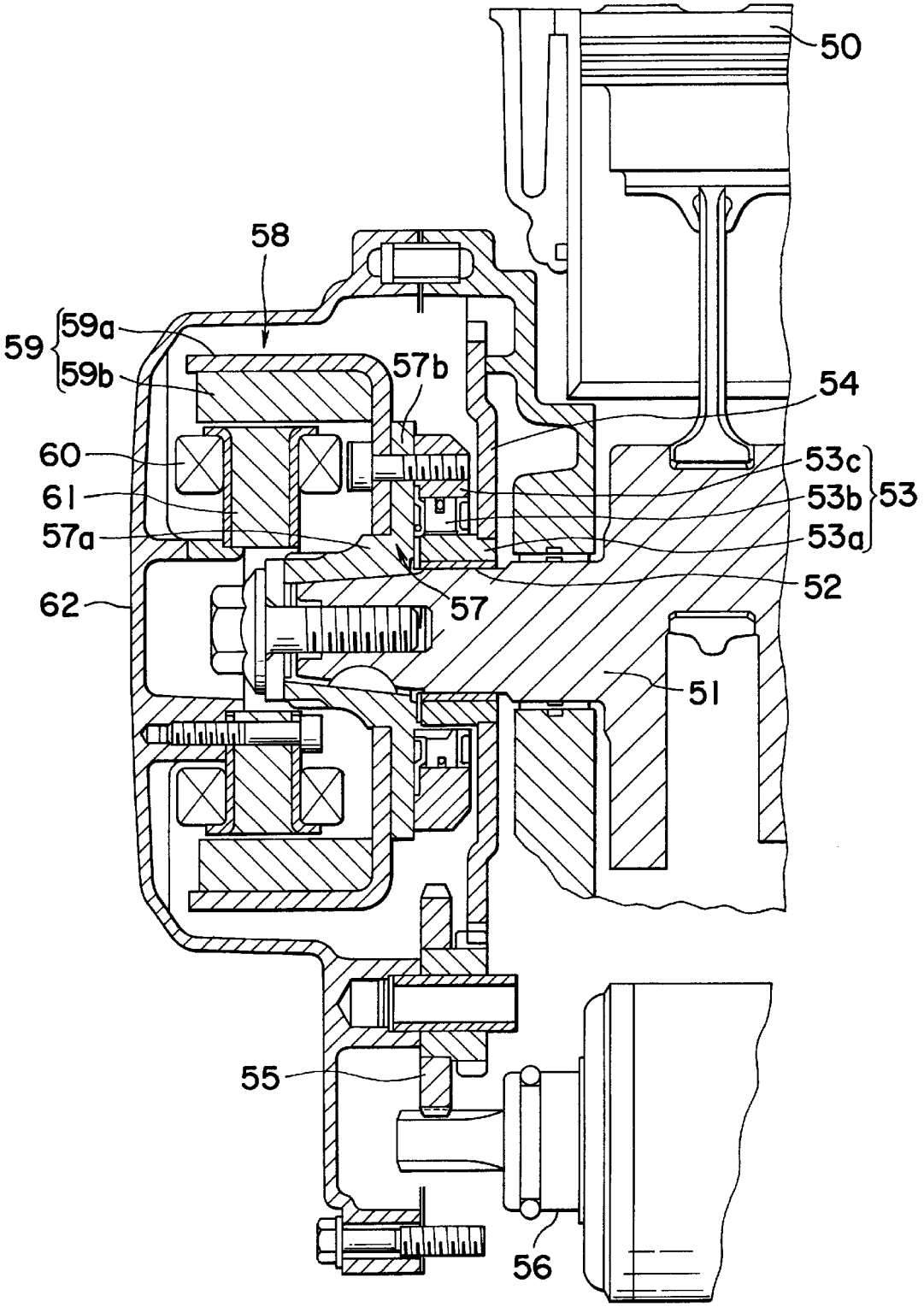
PRIOR ART FIG. 3
FIG. 3 is a fragmentary longitudinal sectional view of an engine provided with a prior art engine starter.

The cam-type overrunning clutch 7 is of a generally known kind. As shown in FIGS. 2(*a*) and 2(*b*), the clutch element 7*b* includes a plurality of cams 7*d* positioned by a wire cage 7*e* held in place with a garter spring 7*g* fitted in grooves 7*f* formed in the radially outer surfaces of the cams 7*d*, and side plates 7*h* and 7*i* are disposed on the opposite sides of the cams 7*d*, respectively, to keep the cams 7*d* at a predetermined axial position on the inner ring 7*a*. The number of the cams 7*d* forming the clutch element 7*b* is relatively large and the cams 7*d* are relatively small. Therefore, the cam-type overrunning clutch 7, as compared with an ordinary roller type overrunning clutch, has a relatively small radial thickness and hence the outer ring 7*c* has a relatively small outside diameter. Accordingly, the use of the cam-type overrunning clutch 7 is effective in miniaturizing the engine starter and reducing the weight of the engine starter.

A limiting plate 25 is fastened with bolts 24 to the inner surface of the rotary member 11 fixedly mounted on the tapered section of the crankshaft 1, to limit the displacement of the side plate 7*i* of the overrunning clutch 7 on the side of the driven gear 8 toward the driven gear 8 and to prevent the side plate 7*i* from coming into contact with the driven gear 8.

The use of the outer ring 7*c* of the overrunning clutch 7 formed integrally with the rotary member 11 reduces the number of parts, time and labor necessary for assembling the engine starter, the weight of the engine starter and the cost of the same. The use of the inner ring 7*a* of the overrunning clutch 7 formed integrally with the driven gear 8 further reduces the number of parts and the cost of the engine starter.

The engine starter provided with the driving gear 10 for driving the balancer 9, formed integrally with the rotary member 11, as compared with the conventional engine starter provided with an individual driving gear for driving the balancer 9, needs less number of parts, requires less time and labor for assembling, has less weight and can be manufactured at reduced cost.

The driving gear 10 formed integrally with the rotary member 11 and used for driving the balancer 9 may be used for driving another engine accessory, such as an oil pump or a water pump.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. An engine starter for starting an engine, comprising:

a starting motor;

a rotor holding rotary member having a boss extending in a first axial direction of the rotary member and fixedly mounted on an end portion of a crankshaft of an engine, said rotary member holding a rotor forming a part of a generator, said rotary member having an outer ring extending integrally therewith in a second axial direction opposite to said first axial direction to define in the outer ring a cylindrical recess with an open end, said rotary member having around the outer ring gear teeth in mesh with a gear for driving an engine accessory;

a driven member to be driven by the starting motor, said driven member being disposed around said end portion of the crankshaft adjacent the outer ring and having an inner ring extending into said cylindrical recess coaxially with and radially inward of the outer ring;

a clutch element disposed between said inner and outer rings to form an overrunning clutch together with the inner and outer rings for transmitting a torque from the inner ring to the outer ring;

side plates provided between said inner and outer rings on axially opposite sides of the clutch element to limit axial displacement of the clutch element; and a limiting plate fixed to a side surface of the rotary member, facing said driven member, and extending radially inward to project into said open end of the cylindrical recess, to thereby limit displacement of the overrunning clutch toward the driven member.

2. The engine starter according to claim 1, wherein the overrunning clutch includes a plurality of cams arranged on a circle between the outer and inner rings.

3. The engine starter according to claim 1, wherein said engine accessory is a balancer.

4. The engine starter according to claim 1, wherein the inner ring of the overrunning clutch is formed integrally with the driven member.

* * * * *